US006390770B1

(12) United States Patent
Takeshita

(10) Patent No.: US 6,390,770 B1
(45) Date of Patent: May 21, 2002

(54) FAN DEVICE AND SHROUD

(75) Inventor: Seiichirou Takeshita, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/485,066

(22) PCT Filed: Jun. 17, 1999

(86) PCT No.: PCT/JP99/03229

§ 371 Date: Feb. 3, 2000

§ 102(e) Date: Feb. 3, 2000

(87) PCT Pub. No.: WO99/66210

PCT Pub. Date: Dec. 23, 1999

(51) Int. Cl.[7] ..... F04D 29/66

(52) U.S. Cl. ..... 415/119; 415/228; 416/169 A; 416/189

(58) Field of Search ..... 415/119, 228, 415/58.6, 58.7; 416/189, 169 A, 500

(56) References Cited

U.S. PATENT DOCUMENTS 3,951,566 A * 4/1976 Mattei et al. ..... 415/115
4,050,845 A * 9/1977 Gemein et al. ..... 415/172 A
4,156,344 A * 5/1979 Cuthbertson et al. ..... 60/226 R
4,836,148 A * 6/1989 Savage et al. ..... 123/41.49
5,839,397 A * 11/1998 Funabashi et al. ..... 123/41.01

FOREIGN PATENT DOCUMENTS

| | | | |
|---|---|---|---|
| GB | 2034435 A | * | 6/1980 |
| JP | 57-157797 | | 4/1982 |
| JP | 61-149600 | | 7/1986 |
| JP | 62-44160 | | 11/1987 |
| JP | 63-30908 | | 8/1988 |
| JP | 64-48000 | | 3/1989 |
| JP | 1-240799 | | 9/1989 |
| JP | 2-70137 | | 5/1990 |
| JP | 4-50498 | | 2/1992 |
| JP | 4-81594 | | 3/1992 |
| JP | 6-10892 | | 1/1994 |
| JP | 7-332284 | | 12/1995 |
| JP | 9-42576 | | 2/1997 |

* cited by examiner

*Primary Examiner*—Edward K. Look
*Assistant Examiner*—Ninh Nguyen
(74) *Attorney, Agent, or Firm*—Mattingly, Stanger & Malur, P.C.

(57) ABSTRACT

A fan apparatus includes a fan having a plurality of blades and producing an air flow with revolution thereof. At least one shroud is disposed upstream of the fan for introducing the air flow to the suction side of the fan. Damping means are provided for taking in the air flow coming out of the fan and damping a radial component of the air flow under an interference action outside an outer periphery of the fan.

6 Claims, 15 Drawing Sheets

FAN DEVICE AND SHROUD

TECHNICAL FIELD

The present invention relates to a fan apparatus including a fan revolved to produce a flow of air, and more particularly to a fan apparatus capable of reducing noise generated due to the revolution of the fan, and a shroud for use with the fan apparatus.

BACKGROUND ART

Heretofore, a side-branch type pulsation reducing apparatus disclosed in JP, A, 9-425756, for example, has been known as a prior-art apparatus in which a small stream path branched from a main stream of a fluid induced by a fluid machine, and a stream going through the branched stream path and back is caused to interfere with the main stream, thereby properly modifying the form of a wave propagating in the main stream.

The disclosed apparatus is installed in, e.g., a construction machine such as a hydraulic excavator. A bottom-equipped side branch is branched from and connected to a delivery line of a hydraulic pump driven by an engine. The pulsation of a hydraulic fluid delivered from the hydraulic pump propagates through the delivery line and a passage in the side branch as well. The pulsation of the hydraulic fluid propagating through the side branch passage is reflected by a wall surface at the end of the side branch, and returns to the delivery line again through the side branch passage. By previously deciding a particular frequency of the pulsation wave to be reduced and appropriately adjusting a length of the side branch passage depending on the particular frequency, therefore, the pulsation wave of the hydraulic fluid, which goes through the side branch passage and returns to the delivery line, is caused to interfere with the pulsation wave propagating straightforward through the deliver line in such a relationship that the hills of one wave collide with the valleys of the other wave. Of the pulsation of the hydraulic fluid advancing straightforward through the deliver line, the pulsation of the particular frequency can be thereby reduced primarily. In this case, the particular frequency is set to, e.g., a pump pulsation frequency (150–1000 hertz) that corresponds to the engine revolution speed of a hydraulic excavator during ordinary excavating work.

On the other hand, an engine apparatus installed in a construction machine and a motor vehicle, for example, comprises an engine, a rotary shaft to which a driving force of a crankshaft of the engine is transmitted, a fan fitted over the rotary shaft, a heat exchanger disposed in front (upstream) of the fan, and a shroud fixed downstream of the heat exchanger. An propeller fan is usually employed as the fan in many cases, and the heat exchanger includes a radiator to which engine cooling water is supplied in a circulating manner. When the engine is driven, rotation of the crankshaft is transmitted to the rotary shaft to revolve the fan, whereupon air is introduced to the heat exchanger from the upstream side for cooling the heat exchanger. The air having passed the heat exchanger is introduced to the suction side of the fan through the shroud and flows into the fan. Then, the air flowing out of the fan further cools the engine.

It has been hitherto known that noise occurs in the above engine apparatus due to revolution of the fan. One conceivable method of reducing the noise is to apply the structure of the above apparatus disclosed in JP, A, 9-42576 to the fan in the engine apparatus. Specifically, by providing a side branch which has a predetermined length and is branched from a wall surface of the shroud defining an air flow passage in an enclosed space extending from the heat exchanger to the fan, a sound wave going through a side branch passage and returning to the shroud is caused to interfere with a sound wave propagating straightforward downstream in the shroud. Of the noise propagating in the shroud, the noise component of a particular frequency can be thereby reduced primarily. In this case, the particular frequency is set to, e.g., a frequency of the fan rotary shaft that corresponds to the engine revolution speed of a hydraulic excavator during ordinary excavating work.

DISCLOSURE OF THE INVENTION

However, the inventors of this application have found that the noise cannot be reduced sufficiently by applying the structure of the above apparatus disclosed in JP, A, 9-42576 to the fan in the engine apparatus. The reasons are as follows.

In the structure introducing air to the suction side of the fan through the shroud like the above engine apparatus, there are two main noise sources. The first is wind chopping noise generated from the ends of fan blades upon the blades revolving while chopping the air flow (referred to simply as wind chopping noise hereinafter). The wind chopping noise occurs regardless of whether the shroud is provided or not. The second is collision noise generated from the wall surface of the shroud upon an air flow colliding against the shroud wall surface after coming out of the fan (referred to simply as collision noise hereinafter). Of those noise sources, the collision noise is dominant in the structure introducing air to the suction side of the fan through the shroud. The side branch type structure such as employed in the apparatus of JP, A, 9-42576 intends to reduce the wind chopping noise primarily, and therefore cannot reduce the collision noise. Thus the noise cannot be reduced sufficiently as a whole.

In consideration of the above result, the inventors of this application have found that it is effective to damp a radial component of the air flow coming out of the fan for reducing the collision noise.

An object of the present invention is to provide a fan apparatus capable of sufficiently reducing noise generated due to revolution of a fan, and a shroud for use with the fan apparatus.

To achieve the above object, the present invention provides a fan apparatus comprising a fan having a plurality of blades and producing an air flow with revolution thereof, and at least one shroud disposed upstream of the fan and introducing the air flow to the suction side of the fan, wherein damping means for taking in the air flow coming out of the fan and damping a radial component of the air flow under an interference action is provided in an outer periphery side of the fan.

The air flow produced with the revolution of the fan is introduced to the suction side of the fan through the shroud, and flows out to the blown-off side of the fan. At this time, noise generates from two main noise sources, i.e., wind chopping noise generated from the ends of fan blades upon the blades turning while chopping the air flow with the revolution of the fan, and collision noise generated from a wall surface of the shroud upon the air flow colliding against the shroud wall surface after coming out of the fan. Of those noise sources, the latter is dominant. Usually, a downstream portion of the shroud is arranged in overlapping relation to the radial outer periphery side of the fan to some extent, and the air flow coming out of the fan radially outward collides against the downstream portion of the shroud, thereby generating the collision noise.

Taking into account the above, in the present invention, the damping means is provided in the outer periphery side of the fan to take in the air flow coming out of the fan and to damp the radial component of the air flow under an interference action, whereby the collision of the air flow against the shroud wall surface is moderated. It is therefore possible to reduce the collision noise that is the dominant noise source, and to reduce the noise generated due to the revolution of the fan sufficiently.

In the above fan apparatus, preferably, the damping means includes at least one bottom-closed pipe disposed with the open side thereof facing the outer periphery side of the fan.

Also, to achieve the above object, the present invention provides a fan apparatus comprising a fan having a plurality of blades and producing an air flow with revolution thereof, and at least one shroud disposed upstream of the fan and introducing the air flow to the suction side of the fan, wherein the fan apparatus includes at least one bottom-closed pipe disposed with the open side thereof facing an outer periphery side of the fan, the bottom-closed pipe having an axial length L that satisfies a relationship of $L=m\times(\pi\times R)/N$ [m] where R is the distance [m] from an outer periphery of the blade to an axis of the fan, the number of the blades is N [pieces], and m is an integer not less than 1.

Assuming that the distance from the outer periphery of the blade to the axis of the fan is R [m], a radial component $V_a$ [m/sec] of the air flow flowing out at a speed V [m/sec] to the blown-off side of the fan is nearly equal to a circumferential speed at a tip end of the blade of the fan, and therefore is expressed by;

$$\begin{aligned} V_a &= R\omega \\ &= R(2\pi/T) \end{aligned}$$

where ω is the angular speed [rad/sec] and T is the cycle [sec] required for the fan to make one revolution.

Also, assuming that a period of time lapsed from the time at which one blade passes a certain point to the time at which the next blade passes the same point is $T_N$ [sec] and the revolution speed of the fan is n [rpm], $T_N$ is expressed by:

$$T_N=60/(n\times N)$$

At this time, since the relationship of $$T=N\times T_N$$

exists between T and $T_N$, the following is resulted:

$$T=60/n$$

By using the above equation, $V_a$ is expressed by:

$$\begin{aligned} V_a &= 2\pi\times R\times(n/60) \\ &= (2\pi\times R\times n)/60 \end{aligned}$$

Here, in the present invention, since the fan apparatus includes the bottom-closed pipe disposed with the open side thereof facing the outer periphery side of the fan, at least part of the radial component of the air flow flowing out to the blown-off side of the fan flows into the bottom-closed pipe. However, since the end of the bottom-closed pipe opposite to the open side is closed, the air flow having entered the pipe is turned by the closed end and returns to the open side again. Given the speed of the air flow flowing into the bottom-closed pipe being $V_a$, the time $T_L$ [sec] required for the air flow to go through the pipe and return it expressed as follows on an assumption that the axial length of the bottom-closed pipe is L [m]:

$$\begin{aligned} T_L &= 2L/V_a \\ &= 2L/\{(2\pi\times R\times n)/60\} \\ &= 2L\times(60/2\pi\times R\times n) \\ &= 60L/(\pi\times R\times n) \end{aligned}$$

Because the bottom-closed pipe is constructed so as to satisfy the relationship of $L=m\times(\pi\times R)/N$ in the present invention, $T_L$ is expressed by:

$$\begin{aligned} T_L &= 60\{m\times(\pi\times R)/N\}/(\pi\times R\times n) \\ &= (60\pi\times m\times R/N)/(\pi\times R\times n) \\ &= 60\times m/(n\times N) \end{aligned}$$

Accordingly, the relationship of $$T_L=m\times T_N$$

is obtained. Stated otherwise, when the radial component of the air flow produced by one blade is turned by the closed end of the bottom-closed pipe and returns to the radially inward open side of the bottom-closed pipe, the next blade or any of the subsequent blades passes just the open side of the bottom-closed pipe. Therefore, the returned air flow collides with the new air flow produced by the next or other blade and advancing radially outward so as to cancel out each other. This phenomenon is repeated successively during the revolution of the fan, whereby the radial component of the air flow coming out of the fan can be damped.

In the above fan apparatus, preferably, the shroud is provided in number one, and the bottom-closed pipe is provided on a fan surrounding portion of the shroud.

In the above fan apparatus, preferably, the bottom-closed pipe is provided to project outward of the fan surrounding portion of the shroud.

In the above fan apparatus, preferably, the bottom-closed pipe is provided to extend along the inner side of the fan surrounding portion of the shroud.

In the above fan apparatus, preferably, the shroud is provided in number two and comprises a first shroud surrounding the fan and a second shroud provided upstream of the first shroud and introducing the air flow to the first shroud, and the bottom-closed pipe is provided on a fan surrounding portion of the first shroud.

Further, to achieve the above object, the present invention provides a shroud disposed upstream of a fan having a plurality of blades and producing an air flow with revolution thereof, the shroud introducing the air flow to the suction side of the fan, wherein a shroud includes damping means for taking in the air flow coming out of the fan and damping a radial component of the air flow under an interference action.

BEST MODE FOR CARRYING OUT THE INVENTION

Embodiments of a fan apparatus of the present invention will be described below with reference to the drawings.

First Embodiment

A first embodiment of the present invention will be described with reference to FIGS. 1–8. This embodiment represents the case in which the present invention is applied to a hydraulic excavator as one example of construction machines.

Figure 1:
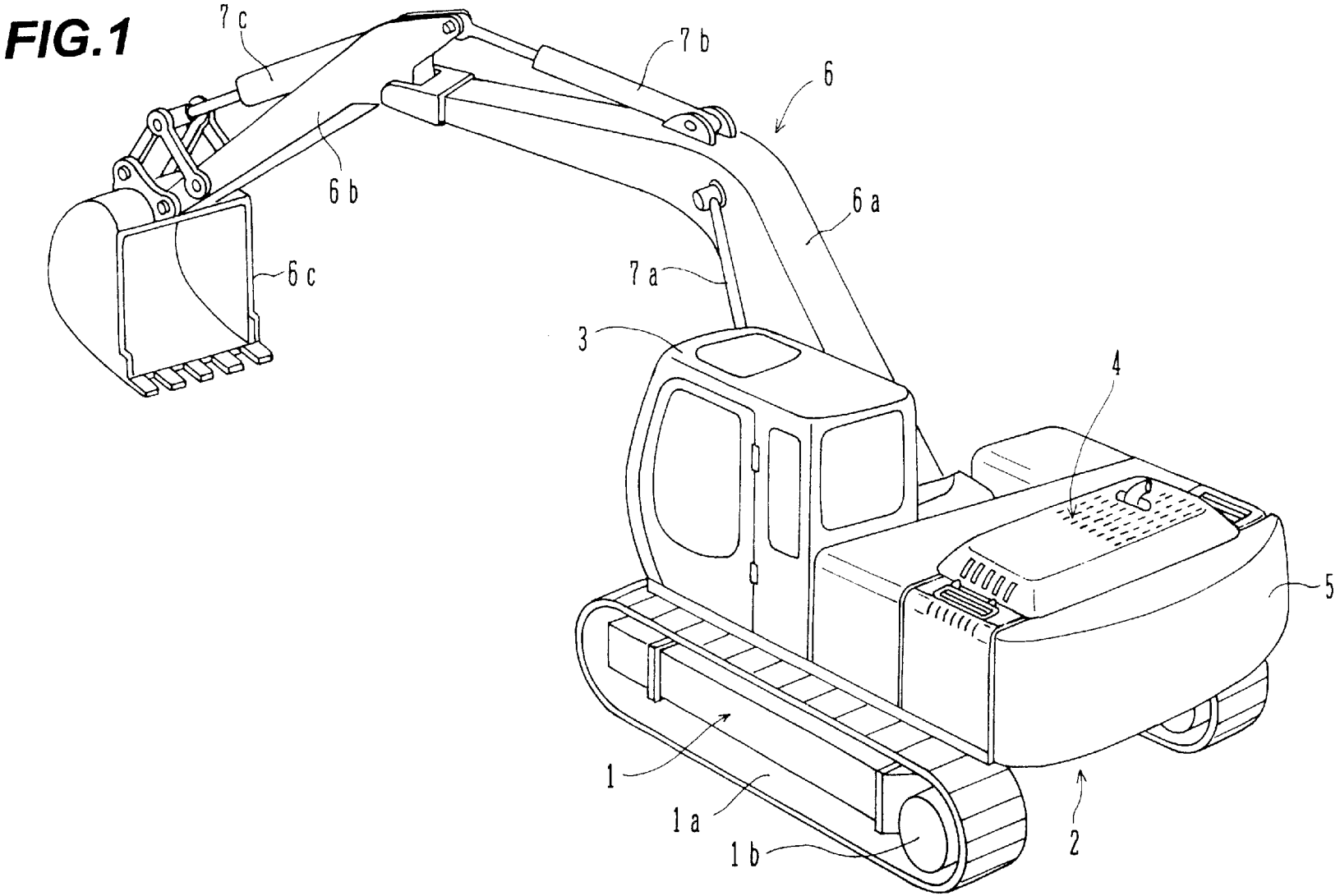
FIG. 1 is a perspective view showing an overall appearance structure of a hydraulic excavator to which a fan apparatus according to one embodiment of the present invention is applied.

FIG. 1 is a perspective view showing an overall appearance structure of a hydraulic excavator to which a fan apparatus according to this embodiment of the present invention is applied. Roughly speaking, the illustrated hydraulic excavator comprises a track body 1, a swing structure 2 mounted on the track body 1 to be able to swing, a cab 3 provided in front of the swing structure 2 on the left side, an engine apparatus 4 disposed on the swing structure 2 to position horizontally sideways, a counterweight 5 provided at the back of the swing structure 2, and a multi-articulated front device 6 attached to a front portion of the swing structure 2 and made up of a boom 6*a*, an arm 6*b* and a bucket 6*c*.

The track body 1 includes a pair of crawler belts 1*a* on both left and right sides. The crawler belts la are driven by the driving forces of respective track motors 1*b*.

The swing structure 2 including the cab 3, the engine apparatus 4, the counterweight 5, the multi-articulated front device 6, etc. is swung relative to the track body 1 by a swing motor (not shown) which is provided in a central portion of the swing structure 2.

The boom 6*a*, the arm 6*b*, and the bucket 6*c*, which construct the multi-articulated front device 6, are operatively driven by a boom cylinder 7*a*, an arm cylinder 7*b*, and a bucket cylinder 7*c* respectively associated with them.

Driving equipment such as the cylinders 7*a*, 7*b*, 7*c*, the swing motor, and the track motors 1*b* are hydraulic actuators and are each driven with a hydraulic fluid in response to an input from a control lever manipulated by an operator in the cab 31 the hydraulic fluid being supplied through a control valve device (not shown) for controlling the hydraulic fluid from a hydraulic pump (not shown, see FIG. 3 below) driven by an engine 8 (not shown, see FIG. 3 below) in the engine apparatus 4.

Figure 2:
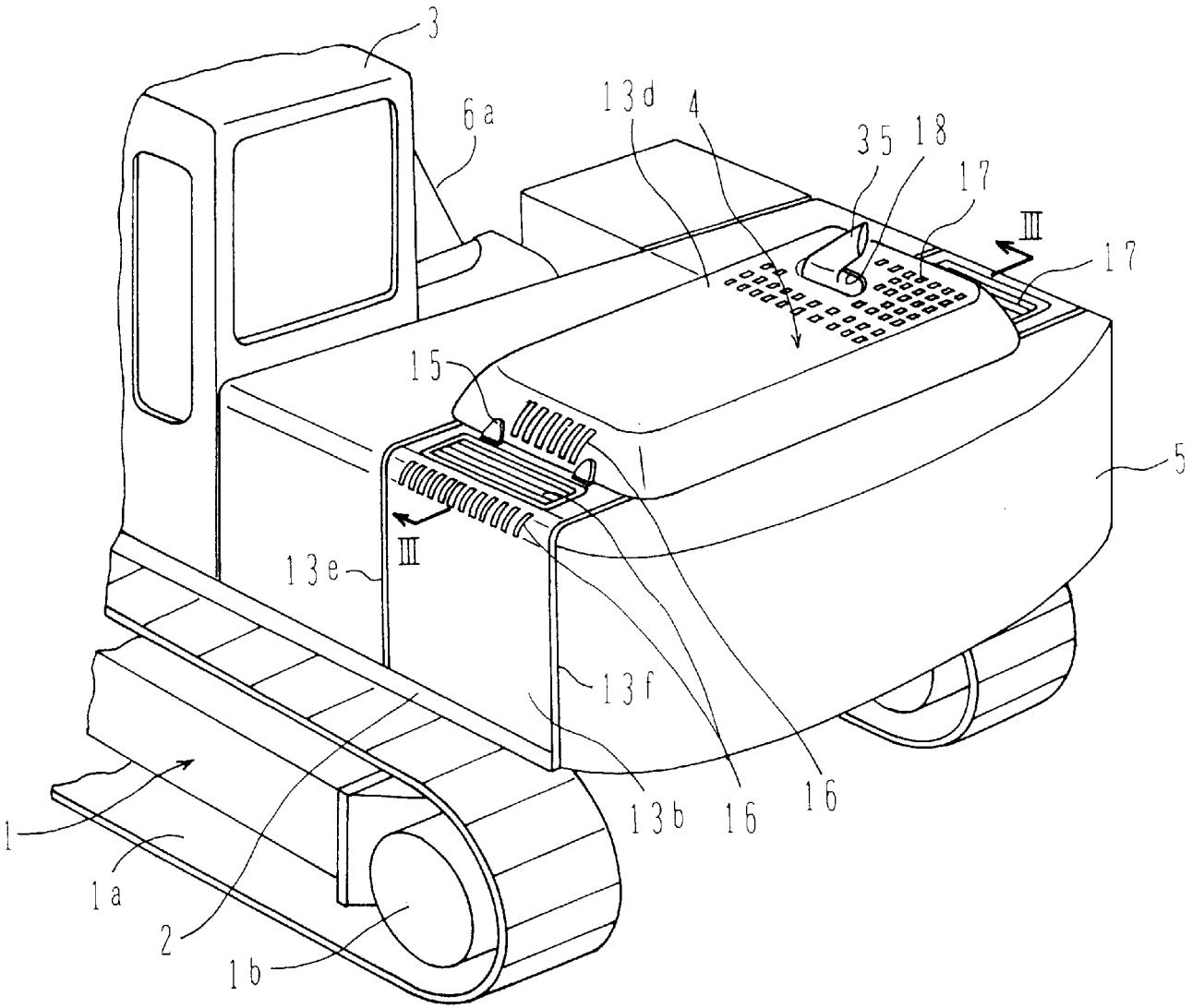
FIG. 2 is a partial enlarged perspective view showing an appearance structure of an engine apparatus shown in FIG. 1.
Figure 3:
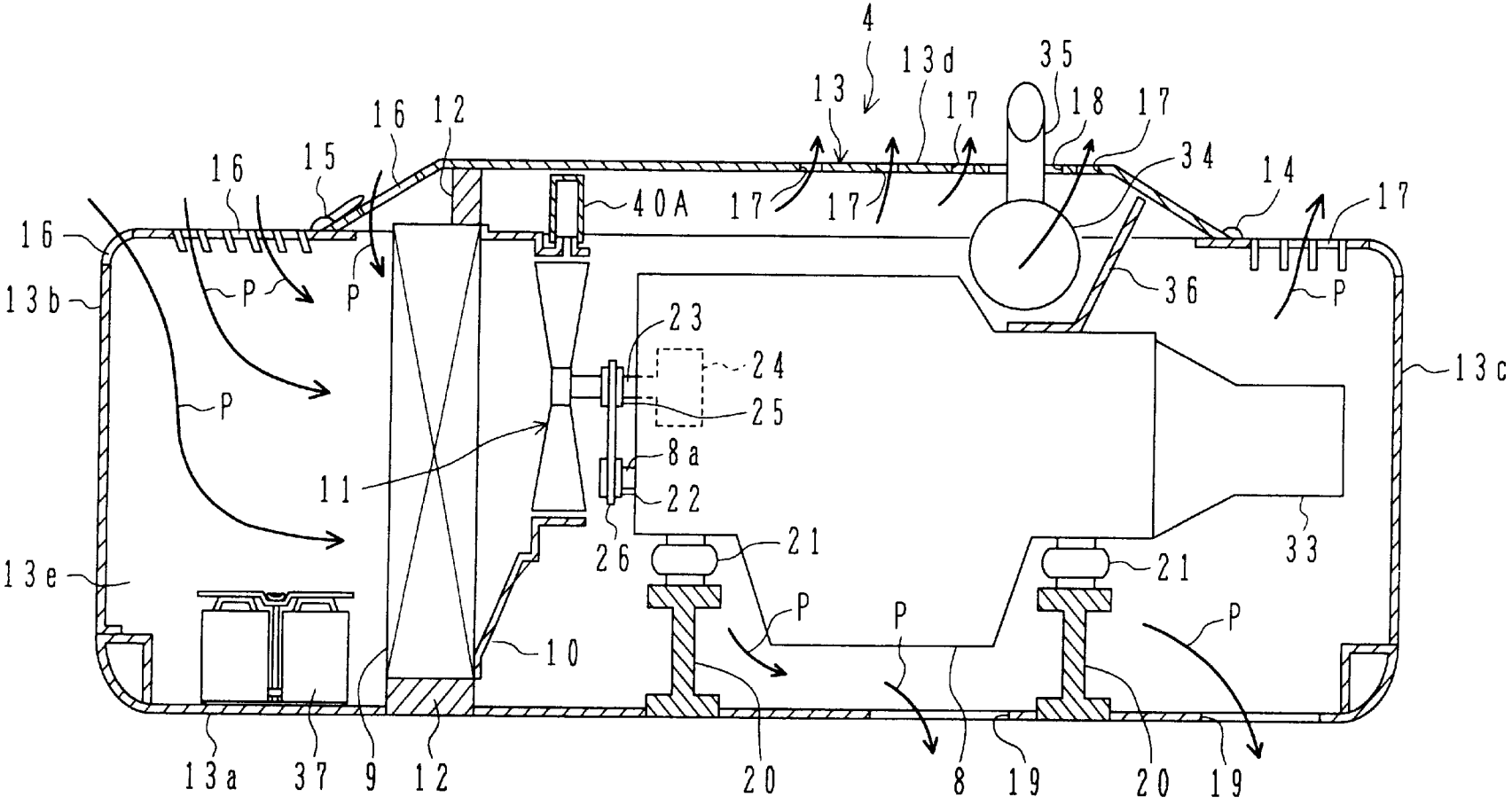
FIG. 3 is a side view, partly sectioned, taken along line III—III in FIG. 2 showing a detailed structure of the engine apparatus in which the fan apparatus according to the first embodiment of the present invention is provided.

FIG. 2 is an enlarged perspective view showing an appearance structure of the engine apparatus 4 to which the fan apparatus according to this embodiment is applied, and FIG. 3 is a side view, partly sectioned, showing a detailed structure of the engine apparatus 4 in which the fan apparatus according to this embodiment is provided. Note that the same symbols in FIGS. 2 and 3 as those in FIG. 1 denote the same components.

In FIGS. 2 and 3, the engine apparatus 4 includes therein a heat exchanger, e.g., a radiator 9, to which cooling water for an engine 8 is supplied in a circulating manner to cool the engine 8, a shroud 10 fixed downstream of the heat exchanger 9, seven bottom-closed pipes 40A provided around the shroud 10, a fan 11 for producing cooling air (air flow) P to cool the heat exchanger 9, and partition members 12 provided for sealing-off along an outer periphery of the heat exchanger 9, including upper and lower portions thereof.

An outer shell of the engine apparatus 4 is constituted by an engine cover 13 which covers such equipment as the engine 8, the fan 11, the heat exchanger 9, hydraulic pump (described later) and a muffler (described later). The engine cover 13 is made up of a lower cover 13*a*, a suction-side (left-hand) lateral cover 13*b*, a delivery-side (right-hand) lateral cover 13*c*, an upper cover 13*d*, a front cover 13*e*, and a rear cover 13*f*.

One end of the upper cover 13*d* is attached to the delivery-side lateral cover 13*c* by a hinge 14 to be able to open and close, and latches 15 are provided at the other end of the upper cover 13*d* so that the opening/-closing-side end of the upper cover 13*d* is latched to the suction-side lateral cover 13*b*. In a portion of the upper cover 13*d* on the side adjacent to the heat exchanger 9 and in the suction-side lateral cover 13*b*, inlet ports 16 are formed for taking in the air flow P from the exterior and introducing the taken-in air to the fan 11. Also, in an opposite-side portion of the upper cover 13*d* and in the delivery-side lateral cover 13*c*, outlet ports 17, 18 are formed for discharging the air flow P blown off from the fan 11 to the exterior. Further, outlet ports 19 are formed in the lower cover 13*a* on the side near the hydraulic pump (described later).

The engine 8 is installed through vibration dampers 21 on frames 20 which are provided in a lower portion of the swing structure 2 and serve as a framework of the swing structure 2. A pulley 22 is fixed to a crankshaft 8*a* of the engine 8. Above the crankshaft 8*a* of the engine 8, an auxiliary rotary shaft 23 is provided to serve as the shaft of the fan 11 and extends into the engine 8. A water pump 24 for circulating the engine cooling water through the heat exchanger 9 via a piping (not shown) is coupled to the end of the auxiliary rotary shaft 23 which locates in the engine 8.

The heat exchanger 9 is disposed in a front stage (upstream) of the fan 11. The partition members 12 provided along the outer periphery of the heat exchanger 9 seal off gaps between the heat exchanger 9 and the upper cover 13*d*, the lower cover 13*a*, the front cover 13*e* and the rear cover 13*f*. The heat exchanger 9 is not limited to only the radiator which has been described above by way of example. Thus, the radiator is merely the least one example of the heat exchanger cooled by the air flow P. In the case of providing other heat exchangers such as an oil cooler for cooling a hydraulic fluid (operating oil) that is used to drive the hydraulic actuators 7*a*–7*c*, etc., an intercooler for precooling air taken in for combustion in the engine 8, and, if necessary, a condenser for an air conditioner, those heat exchangers are also disposed and cooled by the air flow P along with the heat exchanger 9.

The fan 11 comprises the so-called propeller fan, and is attached to the auxiliary rotary shaft 23. A pulley 25 fixed to the auxiliary rotary shaft 23 at a position corresponding to the pulley 22. A belt 26 is looped over the pulleys 22 and 25 to run between them.

Furthermore, the hydraulic pump 33, referred to in the above, is provided adjacent to the engine 8 on the side near the delivery-side lateral cover 13*c*. The hydraulic pump 33 is coupled to the engine 8 through a connecting mechanism (coupling), and is driven by the driving force of the engine 8. Exhaust gas from the engine 8 is discharged outside the engine apparatus 4 through an exhaust gas pipe 35 after passing through a muffler 34 for arrest of sound. Here, a muffler cover 36 is fixedly provided above the engine 8 to prevent oil from scattering toward the side of the engine 8 from the hydraulic pump 33. Additionally, a battery 37 for supplying a current to start up the engine 8 is disposed in the engine apparatus 4 upstream of the heat exchanger 9 (on the left side thereof in FIG. 3).

Figure 4:
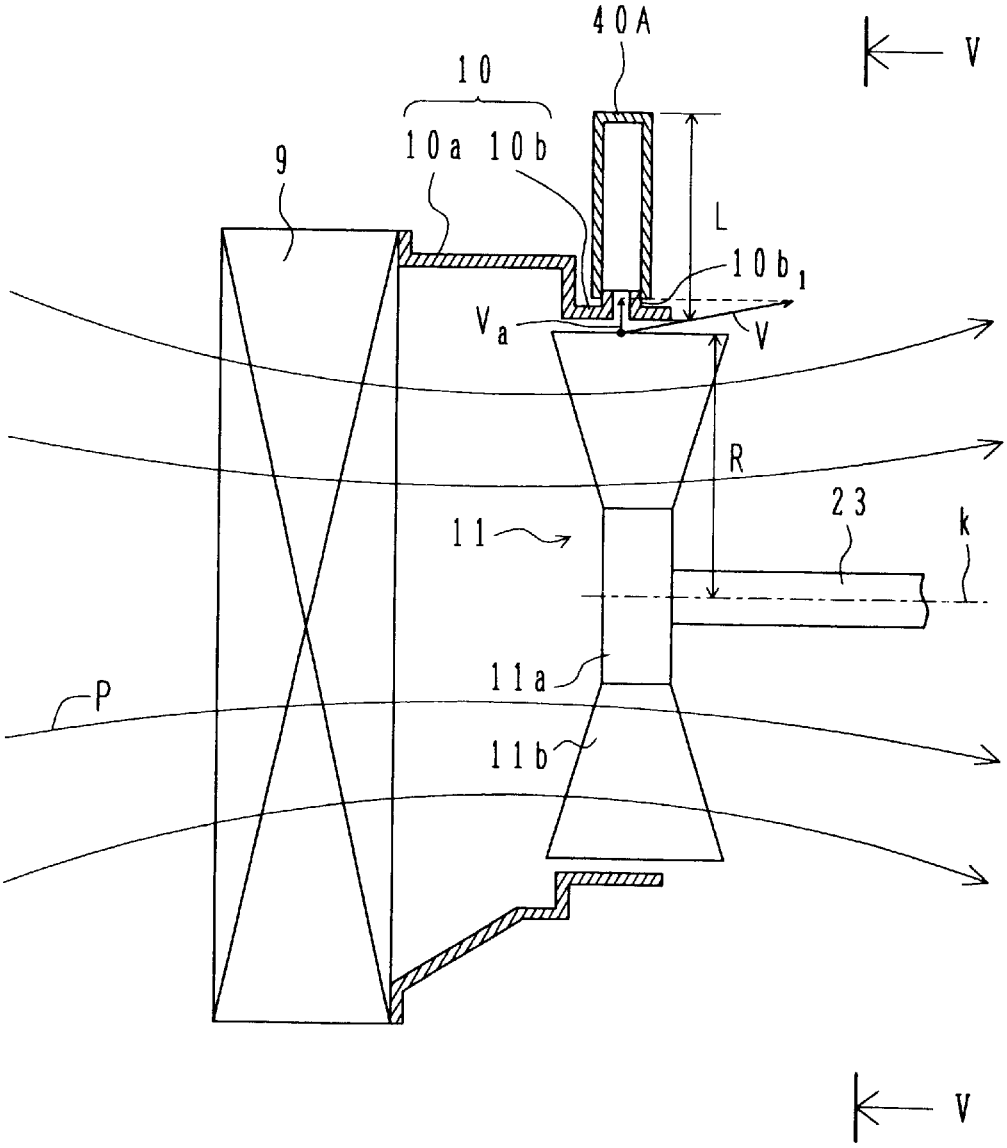
FIG. 4 is a side sectional view showing a principal structure of the engine apparatus shown in FIG. 3.
Figure 5:
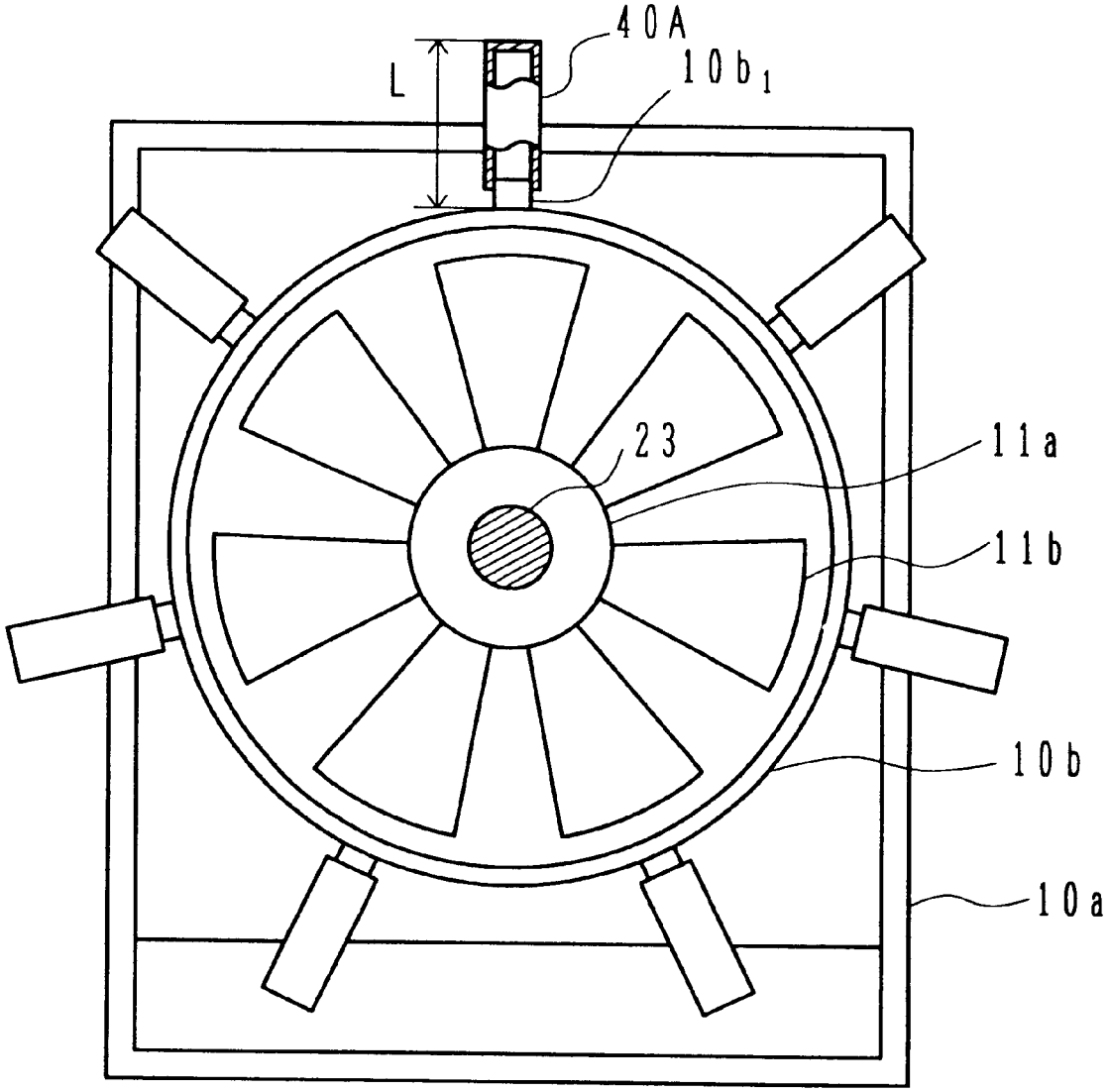
FIG. 5 is a sectional view taken along line V—V in FIG. 4.

A detailed structure of the greatest feature in the above-described construction of the engine apparatus 4, i.e., the fan apparatus according to this embodiment, is shown is FIGS. 4 and 5. FIG. 4 is an enlarged view of a principal part of the fan apparatus shown in FIG. 3, showing a structure of the fan apparatus according to this embodiment, and FIG. 5 is a sectional view taken along line V—V in FIG. 4. Note that the same symbols in FIGS. 4 and 5 as those in FIGS. 1–3 denote the same components.

In FIGS. 4 and 5, the fan 11 comprises a boss 11*a* fixed to the auxiliary rotary shaft 23 to which the driving force is transmitted from the engine crankshaft 8*a*, and a number N (N=7 in this embodiment) of blades 11*b* fixed to an outer periphery of the boss 11*a*. The fan 11 revolves with the rotation of the auxiliary rotary shaft 23, and produces the air flow P (see arrows) flowing to the right in FIGS. 3 and 4.

The shroud 10 is positioned upstream of the fan 11 so as to introduce the air flow P produced by the fan 11 to the suction side of the fan 11. The shroud 10 comprises a front portion 10*a* which is substantially in the box-like form and is fixedly positioned downstream of the heat exchanger 9, and a rear portion 10*b* which is substantially in the cylindrical form and is positioned downstream of the front portion 10*a* and radially outward of the fan 11. Seven projection portions 10*b*1 having passages formed therein are projected from an outer periphery of the rear portion 10*b* for connection to the seven bottom-closed pipes 40A. Base portions of the projection portions 10*b*1 are located to face an outer periphery side of the fan 11.

The bottom-closed pipes 40A are each formed of, e.g., a Teflon hose with its bottom end closed. The bottom-closed pipe 40A is fitted over the projection portion 10*b*1 of the shroud rear portion 10*b*, and a pipe fitted portion is gripped by a gripping means (not shown). The bottom-closed pipe 40A is thereby fixed to the shroud 10 and communicated with an internal space of the shroud 10. An axial length L [m] of a joined assembly of the bottom-closed pipe 40A and the projection portions 10*b*1 is set as follows using the number N of the-blades 11*b;*

$$L=m\times(\pi\times R)/N \qquad \text{(Equation 1)}$$

where R is the distance [m] from an outer periphery of the blade 11*b* to an axis k of the fan 11 (see FIG. 4), and m is an integer not less than 1.

In the above construction, the joined assembly of the bottom-closed pipe 40A and the projection portions 10*b*1 constitutes not only "at least one bottom-closed pipe disposed with the open side thereof facing the outer periphery side of said fan" described in claims, but also "damping means for taking in the air flow coming out of said fan and damping a radial component of the air flow". Further, the rear portion 10*b* of the shroud 10 constitutes "a fan surrounding portion of said shroud" described in claim 4.

The operation of the aforementioned fan apparatus of this embodiment will be described.

When the engine 8 is driven, the rotation of the crankshaft 8*a* is transmitted to the auxiliary rotary shaft 23 through the pulley 22, the belt 26 and the pulley 25. Thereby, the water pump 24 is driven to circulate the cooling water for the radiator 9, and the fan 11 is also driven for revolution. With the revolution of the fan 11, air outside the cover 13 is introduced to the interior of the engine apparatus 4 through the inlet ports 16 to form the air flow P coming in from the upstream side. After cooling the heat exchanger 9, the air flow P is restricted by the shroud 10 while flowing through the inner space of the shroud 10, and is then introduced to the suction side (left side in FIG. 3) of the fan 11. After that, the air flow P flows out to the blown-off side of the fan 11 in the form of an oblique flow at a speed V [m/sec] (see FIG. 4). The cooling air P blown off from the fan 11 cools the engine 8, the hydraulic pump 33, etc. which are disposed downstream of the fan 11, followed by being discharged outside the engine apparatus 4 through the outlet ports 17, 18, 19.

During the above operation, noise generates from the vicinity of the fan 11. There are two main noise sources, i.e., wind chopping noise generated from the ends of fan blades 11*b* upon the blades 11*b* turning while chopping the air flow with the revolution of the fan 11, and collision noise generated from a wall surface of the shroud 10 upon the air flow P colliding against the shroud wall surface after coming out of the fan 11. Of those noise sources, the latter is dominant.

In this embodiment, the radial component of the air flow P coming out of the fan 11 is damped to moderate the collision of the air flow P against the wall surface of the shroud 10 by providing the projection portions 10*b*1 on the rear portion 10*b* of the shroud 10, fitting the bottom-closed pipes 40A to the projection portions 10*b*1, and setting the axial length L of each joined assembly of the projection portion 10*b*1 and the bottom-closed pipe 40A so as to satisfy L=m×(π×R)/N. The principle of the above process will be described below in detail.

Referring to FIG. 4, a radial component $V_a$ [m/sec] of the speed V of the air flow P flowing out to the blown-off side of the fan 11 is nearly equal to a circumferential speed at a tip end of the blade of the fan, and therefore is expressed by;

$$V_a = R\omega \quad \text{(Equation 2)}$$
$$= R(2\pi/T)$$

where ω is the angular speed [rad/sec] and T is the time (=cycle) [sec] required for the fan 11 to make one revolution.

On the other hand, assuming that a period of time lapsed from the time at which one blade 11*b* passes a certain point to the time at which the next blade 11*b* passes the same point is $T_N$ [sec] and the revolution speed of the fan is n [rpm], $T_N$ is expressed by:

$$T_N=60/(n\times N) \quad \text{(Equation 3)}$$

At this time, since the relationship of $$T=N\times T_N$$

exists between T and $T_N$, the following is resulted:

$$T=60/n \quad \text{(Equation 4)}$$

By using Equation 4, the above $V_a$ is expressed by:

$$V_a = 2\pi\times R\times(n/60) \quad \text{(Equation 5)}$$
$$= (2\pi\times R\times n)/60$$

Here, in this embodiment, the bottom-closed pipes 40A are fitted to the projection portions 10*b*1 of the shroud 10, and therefore a part of the radial component of the air flow P flowing out to the blown-off side of the fan 11 flows into the bottom-closed pipes 40A from the projection portions 10*b*1. However, since the bottom-closed pipes 40A are each closed at its bottom end, the air flow having entered each pipe is turned by the closed bottom end and returns toward the fan 11 again. Given the speed of the air flow flowing into the bottom-closed pipe 40A being $V_a$, the time $T_L$ [sec] required for the air flow to go through the pipe and return is expressed by:

$$T_L = 2L/V_a \quad \text{(Equation 6)}$$
$$= 2L/\{(60/2\pi\times R\times n)\}$$
$$= 2L\times(60/2\pi\times R\times n)$$
$$= 60L/(\pi\times R\times n)$$

Because of L=m×(π×R)/N, $T_L$ is expressed as follows by putting this relationship in Equation 6:

$$T_L = 60\{m\times(\pi\times R)/N\}/(\pi\times R\times n) \quad \text{(Equation 7)}$$
$$= (60\pi\times m\times R/N)/(\pi\times R\times n)$$
$$= 60\times m/(n\times N)$$

Accordingly, by comparing Equations 3 and 7, the following relationship is obtained:

$$T_L = m\times x\ T_N \quad \text{(Equation 8)}$$

In the case of m=1, when the radial component of the air flow P produced by one blade 11*b* at a certain point is turned by the closed end of the bottom-closed pipe 40A and returns to the shroud rear portion 10*b* again which is positioned radially inward of the bottom-closed pipe 40A, the next blade 11*b* (any of the subsequent blades 11*b* in the case of m>1) passes just the same point. Therefore, the returned air flow collides with the air flow produced by the next blade 11*b* and advancing radially outward so as to cancel out each other. This phenomenon is repeated successively during the revolution of the fan 11, whereby the radial component of the air flow P coming out of the fan 11 can be damped.

With the fan apparatus of this embodiment, as described above, the radial component of the air flow P coming out of the fan 11 is damped to moderate the collision of the air flow P against the wall surface of the shroud 10. As a result, the collision noise that is a dominant noise source can be reduced, and hence the noise generated due to the revolution of the fan 11 can be reduced sufficiently. One example of the effect resulted with this embodiment is shown in FIG. 6.

Figure 6:
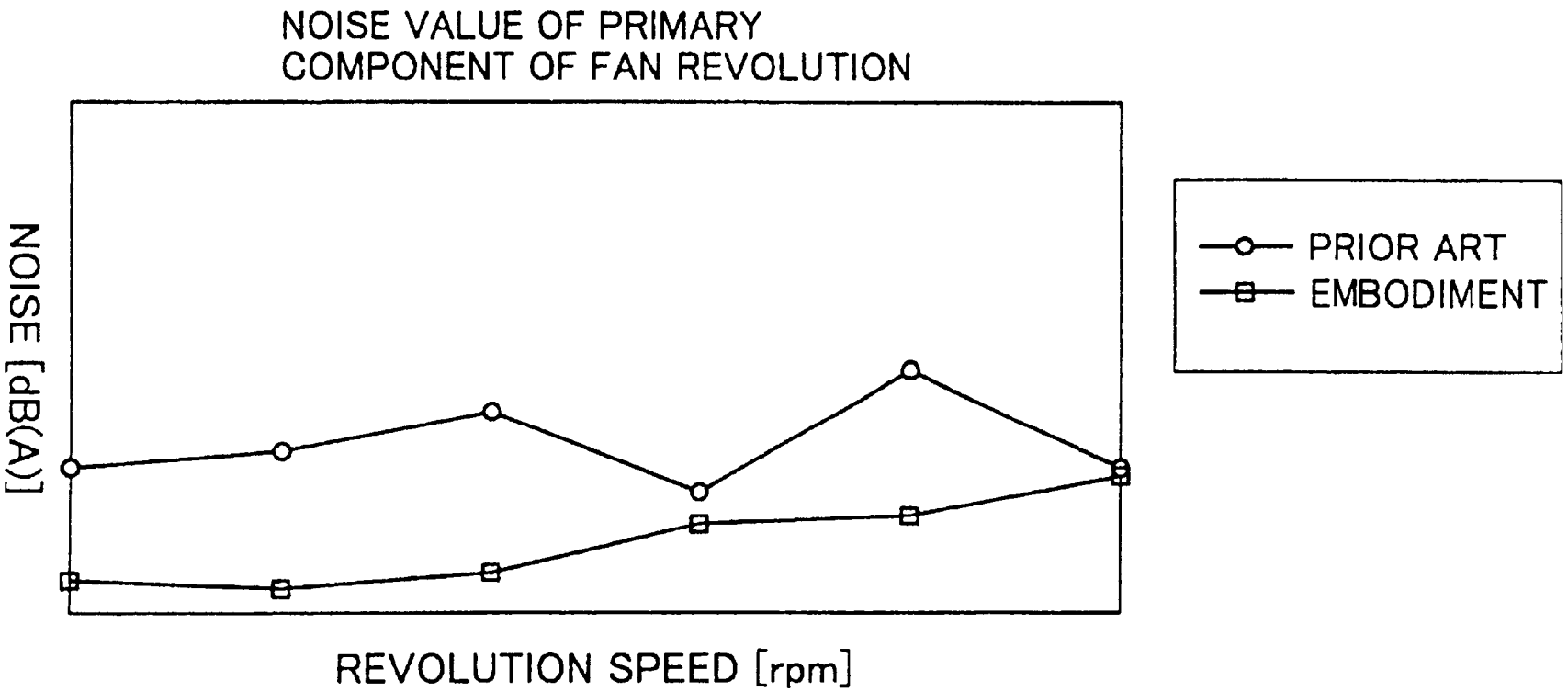
FIG. 6 is a graph showing a noise reducing effect resulted by the fan apparatus shown in FIGS. 3–5.

FIG. 6 comparatively shows noise values [dB] measured on the fan apparatus of this embodiment having the above-described construction and a fan apparatus corresponding to the prior-art structure in which the projection portions 10*b*1 and the bottom-closed pipes 40A are not provided. In the experiment, the noise having a frequency $f_N$ (=n×N/60 [Hz]) that corresponds to a primary component of the revolution speed n of the fan 11 flows was measured. In FIG. 6, the horizontal axis represents the fan revolution speed n [rpm] during the measurement.

As will be apparent from FIG. 6, according to this embodiment, since the collision noise is reduced, the noise of the fan 11 at the primary component of its revolution can be reduced as compared with the prior-art structure over a wide range covering all the revolution speeds.

Also in this embodiment, as will be apparent from Equation 1, the axial length L [m] of the projection portion 10*b*1 and the bottom-closed pipe 40A, which cooperate to develop a noise reducing effect, is determined by only the distance R [m] from the outer periphery of the blade 11*b* to the axis Roof the fan 11 and the number N of the blades 11*b*. According to this embodiment, therefore, it is possible to reduce the collision noise and hence to reduce the total noise regardless of the magnitude of the revolution speed n of the fan 11 unlike the prior art employing the so-called side branch type structure as disclosed in JP, A, 9-42576.

In the above first embodiment, the number of the projection portions 10*b*1 and the bottom-closed pipes 40A is set to the same number as that of the blades 11*b* of the fan 11, the present invention is not limited to such arrangement. Stated otherwise, the noise reducing effect can be obtained by providing at least one set of the projection portions 10*b*1 and the bottom-closed pipes 40A. The larger the number of the sets, the greater is a degree of the effect. Additionally, the projection portions 10*b*1 and the bottom-closed pipes 40A are not always required to be arranged with equal angular intervals as shown in FIG. 5, but may be arranged with unequal angular intervals.

While in the above first embodiment the bottom-closed pipes 40A are each formed of a Teflon hose, the present invention is not limited to the use of a Teflon hose, and the pipe may be formed of, e.g., a steel pipe. Further, the present invention is not limited to the structure connecting the projection portions 10*b*1 and the bottom-closed pipes 40A. The structure may be modified, for example, such that the bottom-closed pipes 40A in the form of steel pipes are directly branched from the shroud rear portion 10*b* and fixed to it by welding. Such a modification can also provide the similar effect as obtainable with the first embodiment.

While in the above first embodiment the rear portion 10*b* of the shroud 10 is substantially in the cylindrical form, the shape of the shroud rear portion 10*b* is not limited to the cylindrical form, but it may be substantially in the bell-mouth form having diameter is decreasing toward the downstream side. Such a modification can also provide the similar effect.

Figure 7:
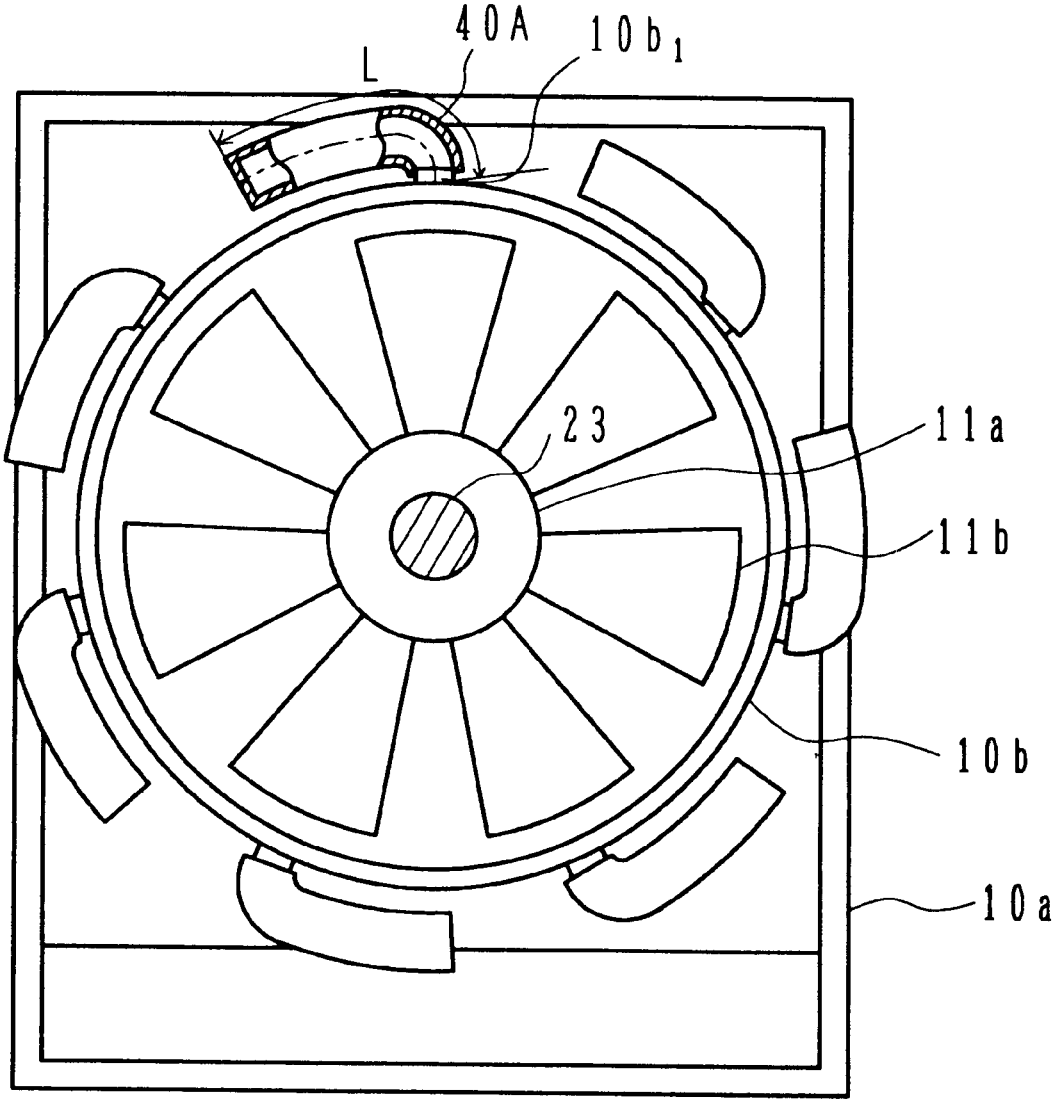
FIG. 7 is a sectional view showing a principal structure of the engine apparatus including a modification of the first embodiment of the present invention in which a bottom-closed pipe is in the form of a substantially curved pipe.
Figure 8:
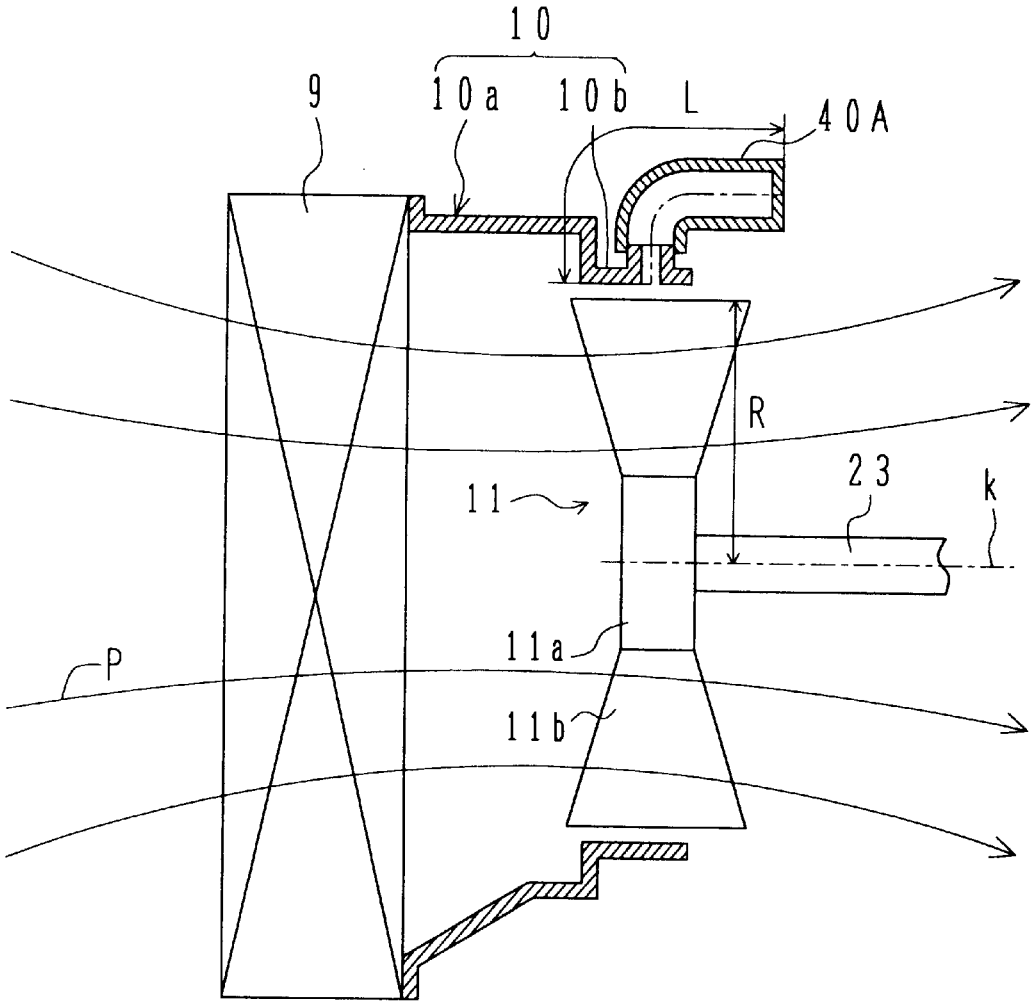
FIG. 8 is a sectional view showing a principal structure of the engine apparatus including another modification of the first embodiment of the present invention in which the bottom-closed pipe is in the form of a substantially curved pipe.

Moreover, while in the above first embodiment the bottom-closed pipes 40A are formed of substantially linear pipes, the present invention is not limited to the use of such pipes. The bottom-closed pipes 40A may be formed of substantially curved pipes which are curved along in the circumferential direction as shown in FIG. 7, or formed of substantially curved pipes which are bent to extend in the axial direction as shown in FIG. 8. These modifications can also provide the similar noise reducing effect as obtainable with the first embodiment so long as the axial length L [m] satisfies Equation 1. As an additional advantage, the construction of the entire apparatus can be made more compact.

Second Embodiment

A second embodiment of the present invention will be described with reference to FIGS. 9–13. This embodiment also represents the case in which the present invention is applied to a hydraulic excavator, as with the above first embodiment.

Figure 9:
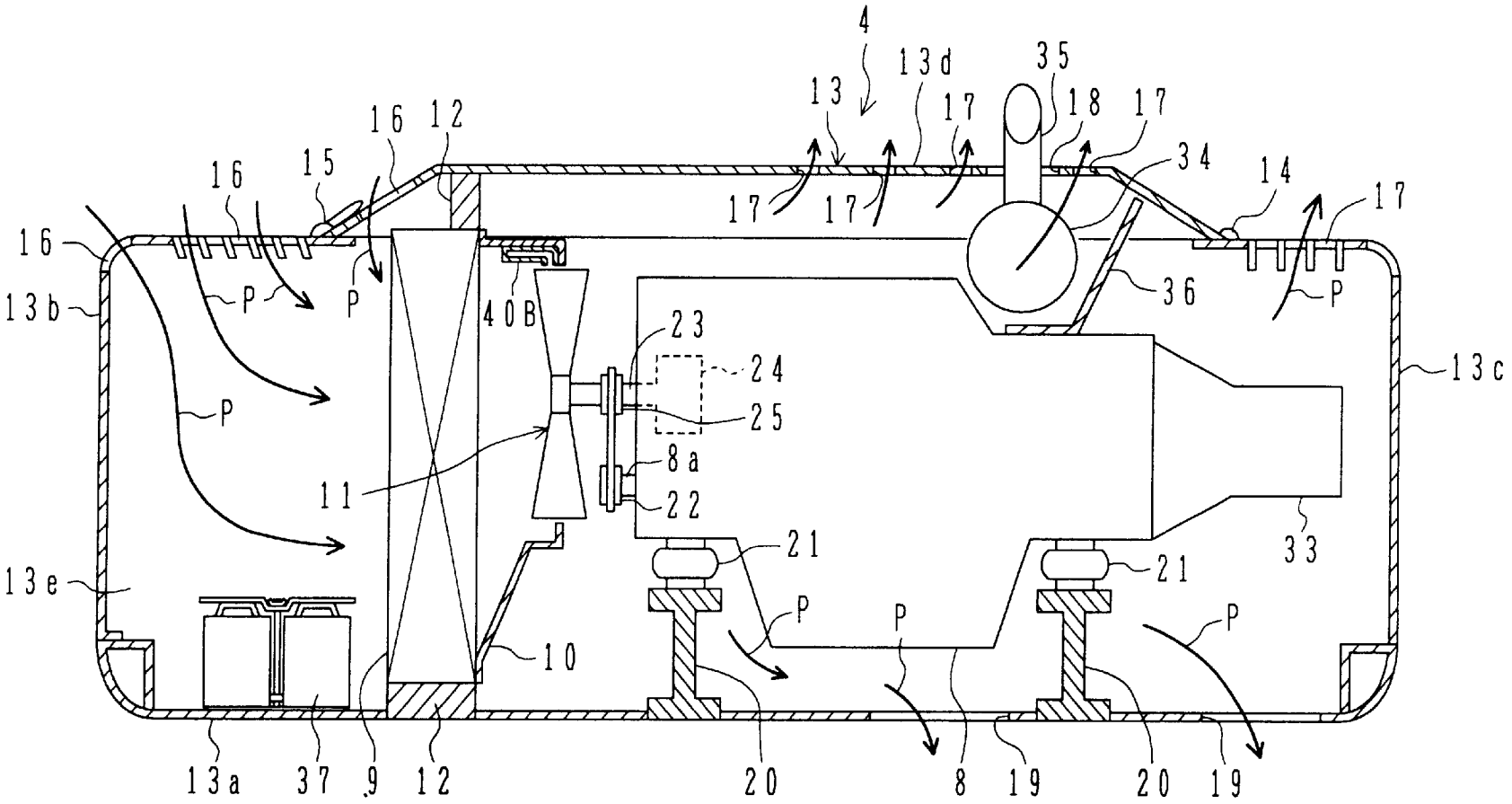
FIG. 9 is a side view, partly sectioned, showing a detailed structure of an engine apparatus in which a fan apparatus according to a second embodiment of the present invention is provided.
Figure 10:
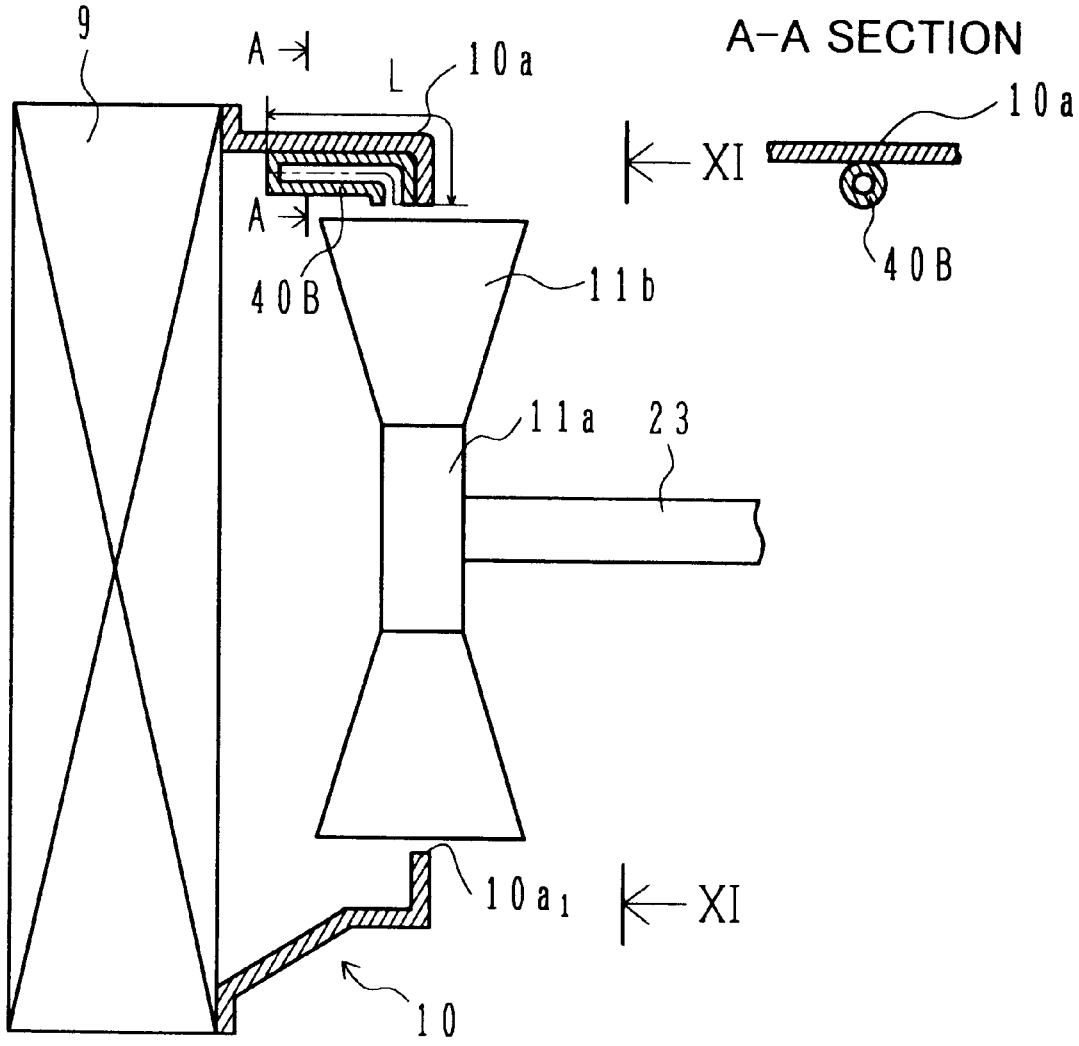
FIG. 10 is a side sectional view showing a principal structure of the engine apparatus shown in FIG. 9.
Figure 11:
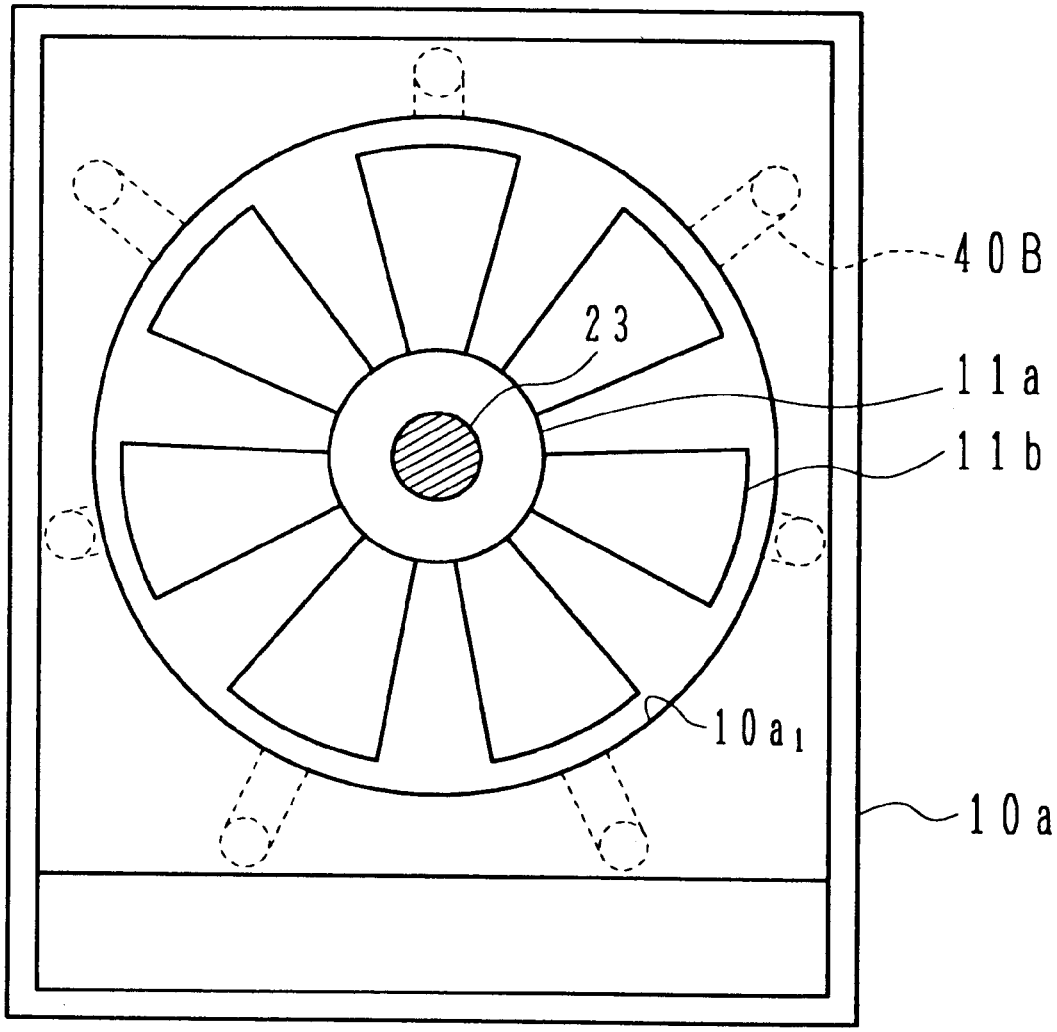
FIG. 11 is a sectional view taken along line XI—XI in FIG. 10.

FIG. 9 is a side view, partly sectioned, showing a detailed structure of the engine apparatus 4 in which a fan apparatus according to this embodiment is provided, FIG. 10 is an enlarged view of a principal part in FIG. 9, showing a structure of the fan apparatus according to this embodiment, and FIG. 11 is a sectional view taken along line XI—XI in FIG. 10. In these drawings, the same symbols as those in FIGS. 1 to 8 denote the same or equivalent components.

The fan apparatus of this embodiment includes a so-called box type shroud 10 which does not have the above-described rear portion 10*b* being substantially in the cylindrical or bell-mouth form. A fan 11 is disposed inside an opening portion 10*a*1 formed at the downstream end of a front portion 10*a* of the shroud 10. Also, as means for taking in the air flow P coming out of the fan 11 and damping a radial component of the air flow P under an interference action, a bottom-closed pipe 40B in the form of a substantially curved pipe is disposed inside the front portion 10*a* of the shroud 10 so as to extend along an inner wall surface of the front portion 10*a*. An axial length L of the bottom-closed pipe 40B is set based on above Equation 1.

Note that, in this embodiment, the front portion 10*a* of the shroud 10 constitutes "the fan surrounding portion of said shroud" described in claim 6.

According to this embodiment, as with the above first embodiment, the radial component of the air flow P coming out of the fan 11 can be damped to reduce the collision noise. As a result, the noise generated due to the revolution of the fan 11 can be reduced sufficiently.

Figure 12:
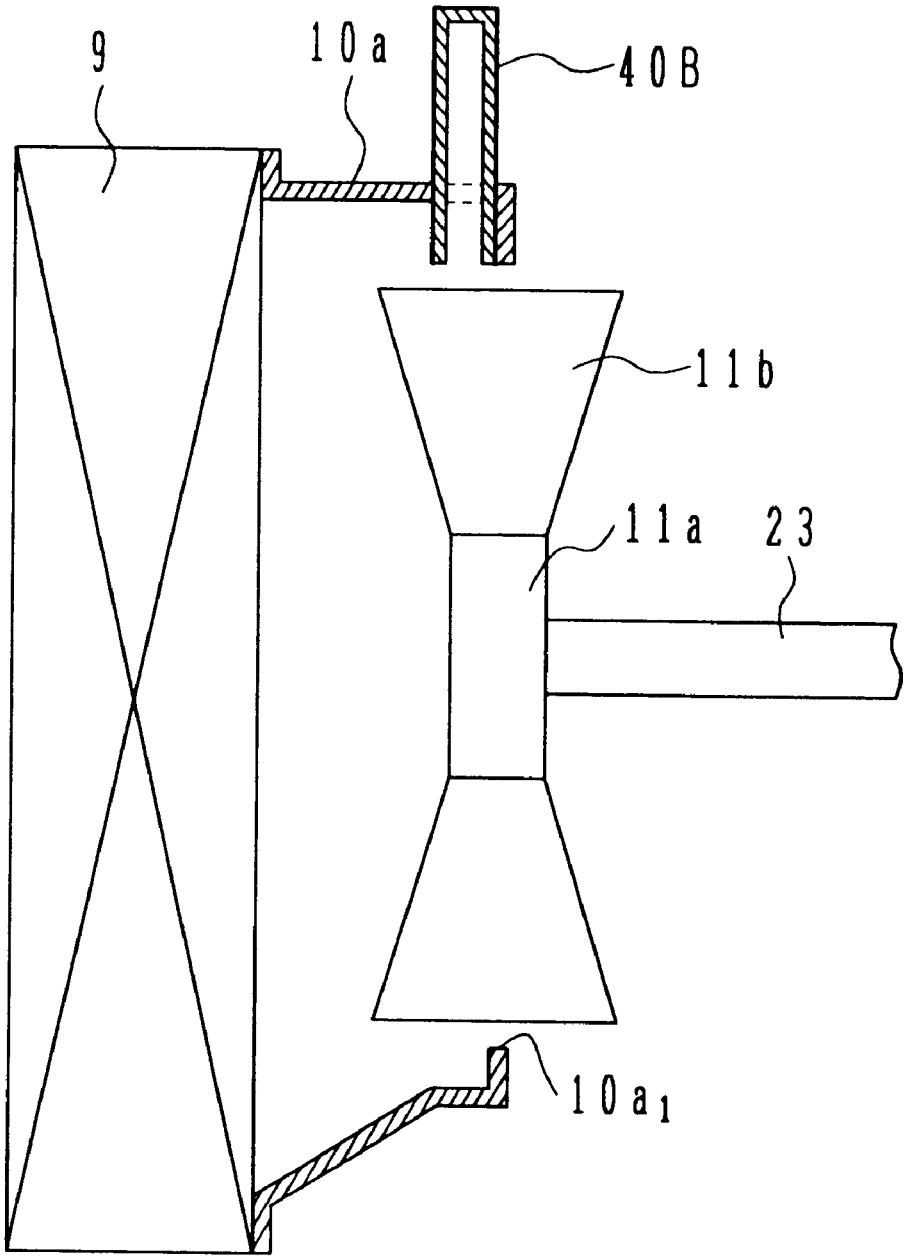
FIG. 12 is a sectional view showing a principal structure of the engine apparatus including a modification of the second embodiment of the present invention in which a bottom-closed pipe is in the form of a substantially linear pipe.
Figure 13:
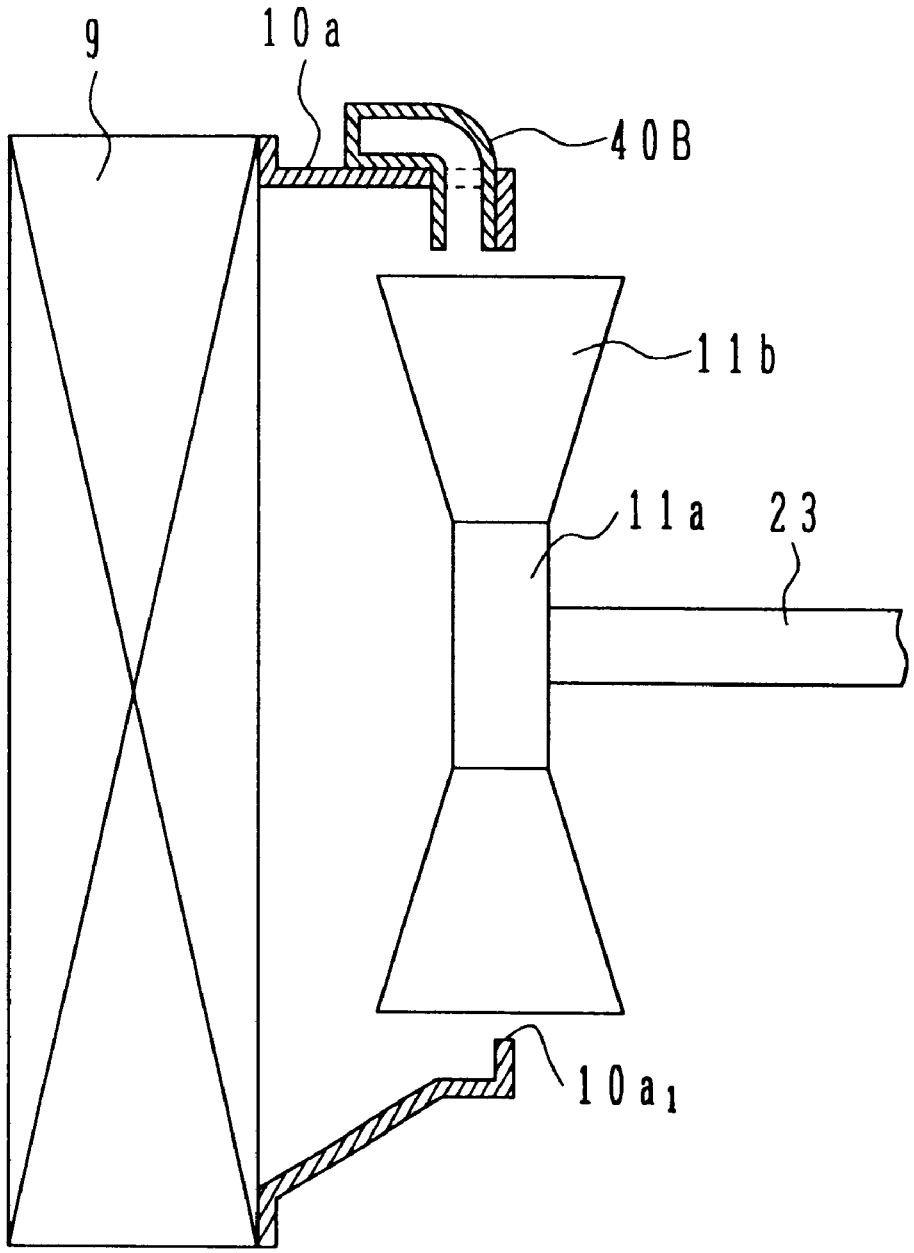
FIG. 13 is a sectional view showing a principal structure of the engine apparatus including another modification of the second embodiment of the present invention in which the bottom-closed pipe is in the form of a substantially curved pipe.

Furthermore, while in this embodiment the bottom-closed pipe 40B is formed of a substantially curved pipe which is bent to extend along the inner wall surface of the shroud front portion 10*a*, the present invention is not limited to the use of such a pipe. The bottom-closed pipe 40B may be formed of a substantially linear pipe penetrating the shroud front portion 10*a* as shown in FIG. 12, or formed of a substantially curved pipe which is bent to extend along an outer wall surface of the shroud front portion 10*a* after penetrating it as shown in FIG. 13. Any of these modifications can also provide the similar effect as obtainable with the above second embodiment so long as the axial length L [m] satisfies above Equation 1.

Third Embodiment

A third embodiment of the present invention will be described with reference to FIGS. 14 and 15. This embodiment also represents the case in which the present invention is applied to a hydraulic excavator, as with the above first and second embodiments.

Figure 14:
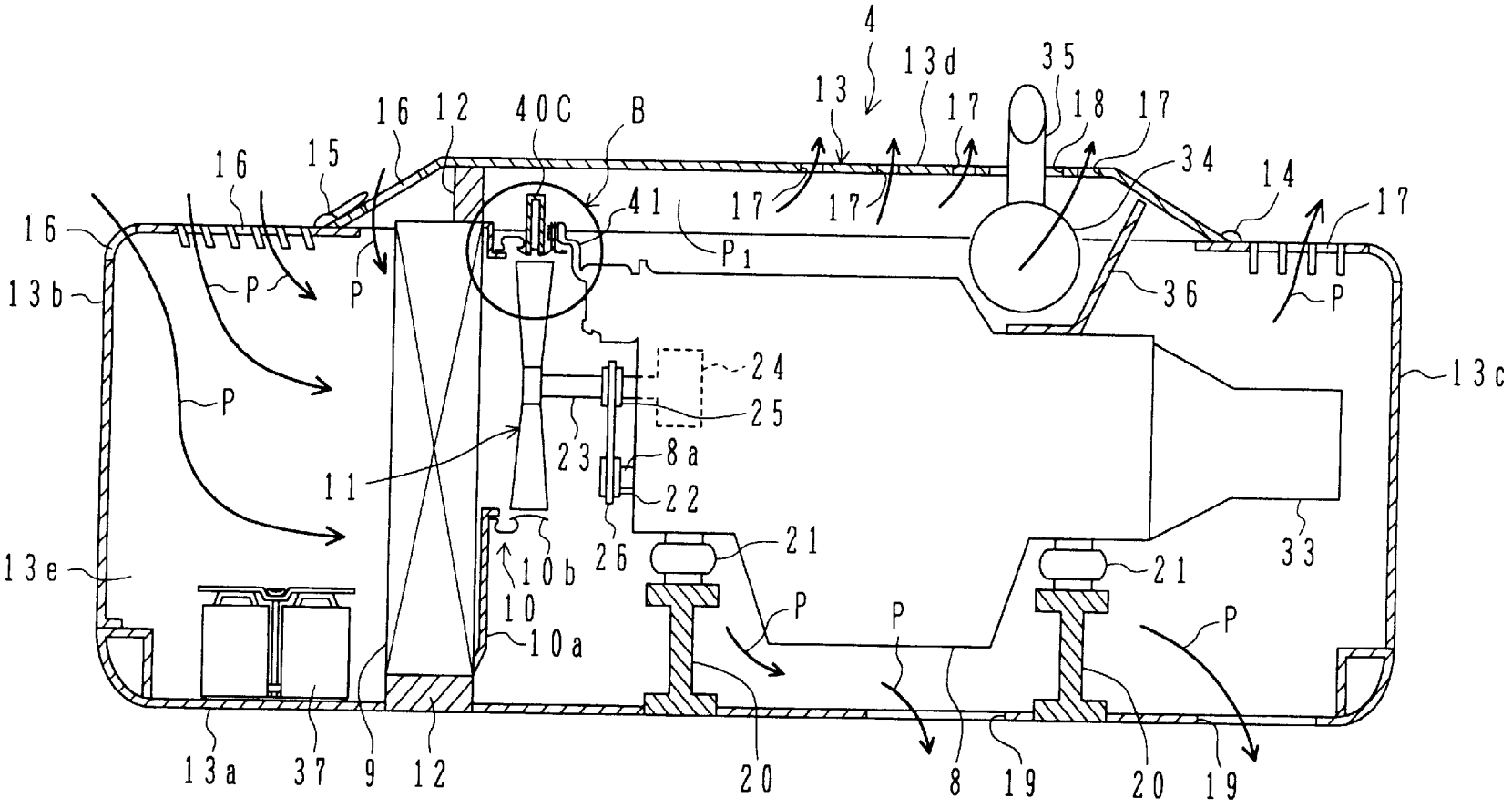
FIG. 14 is a side view, partly sectioned, showing a detailed structure of an engine apparatus in which a fan apparatus according to a third embodiment of the present invention is provided.
Figure 15:
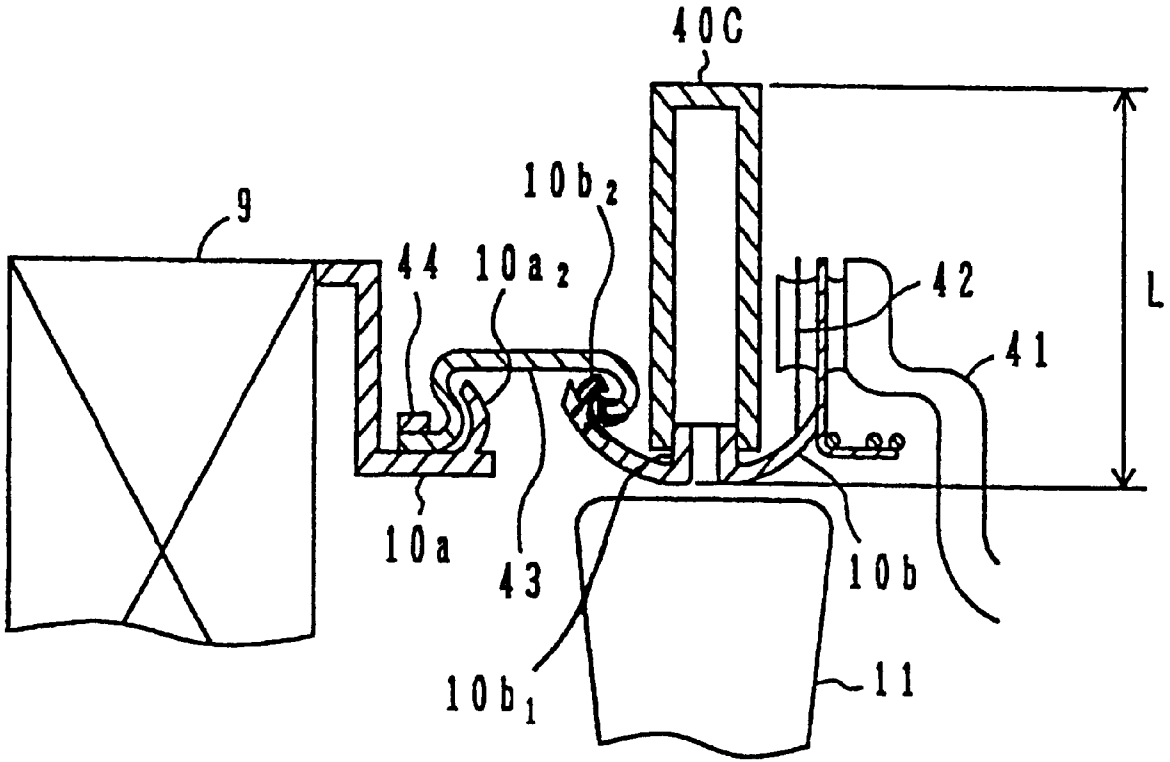
FIG. 15 is an enlarged view of a portion B in FIG. 14.

FIG. 14 is a side view, partly sectioned, showing a detailed structure of an engine apparatus 4 in which a fan apparatus according to this embodiment is provided, and FIG. 15 is a partial enlarged view showing a detailed structure of a portion B in FIG. 14. In these drawings, the same symbols as those in FIGS. 1 to 13 denote the same or equivalent components.

Referring to FIGS. 14 and 15, the fan apparatus of this embodiment includes a two-piece type shroud 10 comprising a front portion 10*a* and a rear portion (also called a fan ring) 10*b* having substantially the bell-mouth form, the front and rear portions 10*a*, 10*b* being separated from each other. More specifically, the front portion 10*a* is fixed to the downstream side (on the right side in FIG. 14) of a heat exchanger 9 as viewed in the direction of an air flow P, whereas the rear portion 10*b* is fixed through fittings 42 to a bracket 41 provided on an engine 8. Engagement portions 10*a*2, 10*b*2 are formed respectively near the downstream end of the front portion 10*a* and the upstream end of the rear portion 10*b*, and a ring-shaped member 43 formed of an elastic material, e.g., rubber, is fitted over the engagement portions 10*a*2, 10*b*2 in such a manner as being caught by them. Then, a band 44 is tightly fastened over the ring-shaped member 43 near its upstream end to prevent the ring-shaped member 43 from moving or slipping off from the engagement portions 10*a*2, 10*b*2. With the above structure, a gap between the shroud front portion 10*a* and the shroud rear portion 10*b* is positively sealed off while allowing a relative displacement between the front portion 10*a* belonging to a vibration system on the side of the heat exchanger 9 and the rear portion 10*b* belonging to a vibration system on the side of the engine 8.

Also, as means for taking in the air flow P coming out of a fan 11 and damping a radial component of the air flow P under an interference action, projection portions 10*b*1 are provided on the rear portion 10*b* of the shroud 10 and bottom-closed pipes 40C in the form of substantially linear pipes are fitted to the projection portions 10*b*1 as with the first embodiment, i.e., in a similar way as shown in FIGS. 3 and 4. An axial length L of a joined assembly of the projection portion 10*b*1 and the bottom-closed pipe 40C is set based on above Equation 1.

Note that, in this embodiment, the rear portion 10*b* of the shroud 10 constitutes "a first shroud surrounding said fan" described in claim 7, and the front portion 10*a* of the shroud 10 constitutes "a second shroud provided upstream of said first shroud and introducing the air flow to said first shroud".

Also according to this embodiment, as with the above first and second embodiments, the radial component of the air flow P coming out of the fan 11 can be damped to reduce the collision noise. As a result, the noise generated due to the revolution of the fan 11 can be reduced sufficiently.

It is needless to say that while in this third embodiment the bottom-closed pipe 40C is formed of a linear pipe, the present invention is not limited to the use of such a pipe, and the bottom-closed pipe 40C may be formed of a substantially curved pipe as shown in FIG. 7 or 8. Any of such modifications can also provide the similar effect as obtainable with the above third embodiment so long as the axial length L [m] satisfies above Equation 1.

Moreover, in the above first to third embodiments, the bottom-closed pipes 40A, 40B, 40C are in the form of substantially round pipes. However, the present invention is not limited to the use of such a pipe, the bottom-closed pipes may be, e.g., rectangular in cross-section.

Additionally, the above first to third embodiments have been described in connection with, for example, the case of applying the present invention to an engine apparatus of a hydraulic excavator. However, the application field is not limited to such a case, and the present invention is also applicable to engine apparatus of other construction machines, e.g., cranes, self-running crushers, and wheeled loaders. Further, the application field is not limited to engine apparatus, and the present invention is applicable to any other apparatus having a structure in which air is introduced to the suction side of a fan through a shroud. These cases can also provide the similar effect as obtainable with the above embodiments.

INDUSTRIAL APPLICABILITY

According to the present invention, damping means are provided in an outer periphery side of a fan to take in an air flow coming out of the fan and to damp a radial component of the air flow under an interference action. It is therefore possible to reduce the collision noise that is a dominant noise source, and to reduce the noise generated due to revolution of the fan sufficiently.

What is claimed is:

1. A fan apparatus comprising a fan having a plurality of blades and producing an air flow with revolution thereof, and at least one shroud disposed upstream of said fan and introducing the air flow to the suction side of said fan, and wherein:

damping means for taking in the air flow coming out of said fan and damping a radial component of the air flow under an interference action is provided in an outer periphery side of said fan;

said damping means including at least one bottom-closed pipe disposed with the open side thereof facing the outer periphery side of said fan.

2. A fan apparatus according to claim 1, wherein said shroud is provided in one piece, and said bottom-closed pipe is provided on a fan surrounding portion of said shroud.

3. A fan apparatus according to claim 2, wherein said bottom-closed pipe is provided to project outward of the fan surrounding portion of said shroud.

4. A fan apparatus according to claim 2, wherein said bottom-closed pipe is provided to extend along the inner side of the fan surrounding portion of said shroud.

5. A fan apparatus according to claim 1, wherein said shroud (10*a*, 10*b*) is provided in two parts and comprises a first shroud surrounding said fan and a second shroud provided upstream of said first shroud and introducing the air flow to said first shroud, and said bottom-closed pipe is provided on a fan surrounding portion of said first shroud.

6. A fan apparatus comprising a fan having a plurality of blades and producing an air flow with revolution thereof, and at least one shroud disposed upstream of said fan and introducing the air flow to the suction side of said fan, wherein:

said fan apparatus includes at least one bottom-closed pipe disposed with the open side thereof facing an outer periphery side of said fan, said bottom-closed pipe having an axial length L that satisfies a relationship of;

$$L=m\times(\pi\times R)/N\ [m]$$

Where R is the distance m from an outer periphery of said blade to an axis of said fan, the number of said blades is N, and m is an integer not less than 1.

* * * * *